US007327251B2

(12) United States Patent
Corbett, Jr.

(10) Patent No.: US 7,327,251 B2
(45) Date of Patent: Feb. 5, 2008

(54) RFID SYSTEM FOR LOCATING PEOPLE, OBJECTS AND THINGS

(76) Inventor: Bradford G. Corbett, Jr., 1300 E. Berry St., Fort Worth, TX (US) 76119

( * ) Notice: Subject to any disclaimer, the term of this patent is extended or adjusted under 35 U.S.C. 154(b) by 211 days.

(21) Appl. No.: 11/138,024

(22) Filed: May 26, 2005

(65) Prior Publication Data

US 2005/0270158 A1 Dec. 8, 2005

Related U.S. Application Data

(60) Provisional application No. 60/575,432, filed on May 28, 2004.

(51) Int. Cl.
*G08B 1/08* (2006.01)

(52) U.S. Cl. ..... 340/539.13; 340/5.2; 340/539.16; 340/572.1; 340/572.8; 340/573.1; 340/573.4; 455/404.2

(58) Field of Classification Search ..... 340/539.13, 340/5.2, 5.8, 539.15, 825.36, 573.1, 573.4, 340/5.81, 539.1, 572.1, 572.8; 455/404.1, 455/404.2

See application file for complete search history.

(56) References Cited

U.S. PATENT DOCUMENTS 6,424,264 B1 * 7/2002 Giraldin et al. ..... 340/573.1
6,509,829 B1 * 1/2003 Tuttle ..... 340/10.1
6,617,970 B2 * 9/2003 Makiyama et al. ..... 340/573.1
6,747,562 B2 * 6/2004 Giraldin et al. ..... 340/573.1
6,788,200 B1 * 9/2004 Jamel et al. ..... 340/539.13
7,064,663 B2 * 6/2006 Pucci et al. ..... 340/539.32
7,151,454 B2 * 12/2006 Washington ..... 340/572.1
7,180,420 B2 * 2/2007 Maurer ..... 340/572.1
2003/0018534 A1 * 1/2003 Zack et al. ..... 705/22
2005/0145688 A1 * 7/2005 Milenkovic et al. ..... 235/375
2005/0253704 A1 * 11/2005 Neuwirth ..... 340/539.13
2005/0253725 A1 * 11/2005 Neuwirth et al. ..... 340/572.8
2005/0258937 A1 * 11/2005 Neuwirth ..... 340/5.92
2005/0258956 A1 * 11/2005 Neuwirth ..... 340/539.13

* cited by examiner

*Primary Examiner*—Davetta W. Goins
(74) *Attorney, Agent, or Firm*—Charles D. Gunter, Jr.

(57) ABSTRACT

A monitoring and location system for mobile objects is shown which includes a control center to monitor the movement of mobile objects to and from a prescribed local area and a prescribed wide area. Each mobile object is provided with a separate RFID tag which has a unique electronic indicia stored thereon for transmission by a radio frequency signal upon request from an RFID interrogation unit. The local areas includes egress zones and ingress zones, each zone having its own RFID interrogation unit for monitoring the ingress and egress, respectively, of its own group of RFID tags. When an RFID tag has egressed or ingressed one of the zones, the RFID transmits its unique electronic indicia to the RFID interrogation unit of one of the zones, and when the RFID interrogation unit has received the indicia, the RFID interrogation unit transmits a signal including such indicia to the control center. The control center transmits information concerning the location of the mobile object to an end user by means of a dedicated personal electronic device carried or worn by the end user.

11 Claims, 2 Drawing Sheets

RFID SYSTEM FOR LOCATING PEOPLE, OBJECTS AND THINGS

CROSS REFERENCE TO RELATED APPLICATION

The present U.S. patent application claims priority from earlier filed U.S. Provisional Patent Application Ser. No. 60/575,432, filed May 28, 2004, entitled "RFID System for Locating People, Objects and Things".

BACKGROUND OF THE INVENTION

1. Field of the Invention

The present invention relates generally to monitoring and locating systems, and more specifically to a system for tracking in real time the location of individuals, pets or objects within a defined environment such as a ball park, playground, theme park or other such fixed activity environment using radio frequency identification (RFID) technology.

2. Description of the Prior Art

Tracking the location of an individual or an object or even an animal such as a domesticated animal or a pet that can move in unknown directions over a considerable range of territory presents an interesting challenge. A number of systems have been proposed which employ existing wireless communication capabilities but which tend to be cumbersome, bulky and expensive. With the advent of global positioning system (GPS) services, it has been possible to provide relatively inexpensive location systems for determining the location of a moving object. These type systems have been used, for example, on trucks to provide location information for companies that have large fleets of trucks in use at any one particular time. However, the global positioning system (GPS) has some disadvantages in that it is relatively slow in acquiring the location data and it is strongly dependent upon the target object being in an open area where it is in a line of sight position relative to at least three GPS satellites. A further disadvantage, particularly in a small, portable unit, is that the GPS receiver that must be included in a locating device requires the use of substantial electrical energy during the period in which the location information is being acquired and developed from the GPS system. Further, a small portable object locator, in addition to minimizing the use of electrical power while being subject to less than ideal orientations must also be very simple in design and economical to manufacture.

There are numerous prior art references which are directed toward the problem of locating and tracking people, objects and pets. For example, Joseph Hoshens, U.S. Pat. No. 5,461,390, teaches a system designed to track stalkers, stalkees, abducted or stolen animals or objects to which tags are attached.

The system is based on a cell phone-type network. Polling signals are sent to transceivers (repeaters) in each cell which then broadcast the polling signals to each of the tags. Each of the polled tags then interrogates a unit of a global positioning system to obtain its coordinate position. This information is then broadcast to the control center via the repeaters. Alternately, the tags can transmit signals which are triangulated by the control center data processor to obtain the tag location. The coordinates are then, in the case of a stalker, compared with the spatial coordinates of locations, permitted to the stalker or the stalker's spatial relationship to the stalkee. If the stalker is in a nonpermitted area, or too close to the stalkee, police are then notified of the fact. In the case of an abducted child, the presence of the child in a location outside a designated area would trigger a notification of the police. Alternately, the child can trigger an abduction-in-progress alarm.

J. C. Otto, et al, U.S. Pat. No. 5,870,029, teaches the location of objects or persons, e.g., a person under house arrest, within designated areas. A police car acting as a mobile transceiver is dispatched to apprehend the fugitive when he or she is outside the designated areas. A geo-positioning system is utilized to provide the necessary spatial coordinates. The mobile transceiver utilizes signal strength, ranging Doppler effects, phase shifting, radio direction, time difference of signals arrived and radio frequency ranging for determining the location of the tagged individual or object.

U.S. Pat. No. 5,883,598, to Parl, et al., teaches a location system designed to augment cellular phone or paging systems which utilizes identification tags. Each tag transmits locating signals to one or more repeaters within the cell areas. A base station relay within the cell areas receives the locating signals and transmits to the control center signals indicative of the phase and amplitude of each locating signal as received.

The above references are merely intended to be illustrative of the state of the art in locating system technologies. Most of these systems are extremely complicated and expensive to implement. While such systems may prove useful in, for example, law enforcement, fleet trucking, child abduction, and the like, a need exists for a much simpler and economical alternative for use in, for example, monitoring the location of a child within a defined environment such as a school building, sports arena, playground or theme park.

SUMMARY OF THE INVENTION

The present invention, briefly described, includes a user identification tag worn by a mobile object such as an individual of a particular group being monitored and has means for communicating with each tag as it moves with the individual through a subject environment. The system also uses strategically placed interrogation units distributed within the environment which provide information on ingress and egress from the environment, including means for sounding an alert when a particular individual leaves the environment.

More specifically, a monitoring and location system is shown for monitoring mobile objects which includes a control center to monitor the movement of mobile objects to and from a prescribed local area and a prescribed wide area. A separate RFID tag is provided for each mobile object of a group being monitored. Each RFID tag has a unique electronic indicia stored thereon for transmission by a radio frequency signal upon request from an RFID interrogation unit. Preferably, each of the prescribed areas comprises a plurality of zones which include egress zones and ingress zones. Each zone has its own RFID interrogation unit for monitoring the ingress and egress, respectively, of its own group of RFID tags. When an RFID tag has egressed or ingressed one of the zones, the RFID tag transmits its unique electronic indicia to the RFID interrogation unit of one of the zones. When the RFID interrogation unit has received the indicia, the RFID interrogation unit transmits a signal including the indicia to the control center.

Preferably, the RFID tag is carried upon a person to be tracked and is affixed to a selected one of a garment, hat or shoes of the person. Most preferably, the RFID tag is sewn within a lining of an article of clothing worn by the person to be tracked. The control center preferably sends an alert to a system user (such as a concerned parent) when an RFID tag being tracked leaves a selected one of the local or wide areas by means of a personal electronic device carried by the system user. The preferred personal electronic device is selected from the group consisting of a cell phone, a PDA and a wrist watch.

Because the preferred RFID tags are sewn into the hems of garments which may be washed or dry cleaned on numerous occasions, they must be very robust. For garment applications, the RFID is preferably encapsulated in an encapsulating material which renders it impervious to normal environmental influences such as water, cleaning solvents temperature and pressure which are encountered in laundry and dry cleaning operations. In one particularly preferred embodiment of the invention, the RFID is encapsulated in a liquid resin which is subsequently cured. In another embodiment of the invention, the electrical components of the RFID are physically isolated from the environment by enclosing the components between top and bottom layers of a heat and shock resistant material.

Additional objects, features and advantages will be apparent in the written description which follows.

DETAILED DESCRIPTION OF THE INVENTION

Figure 1:
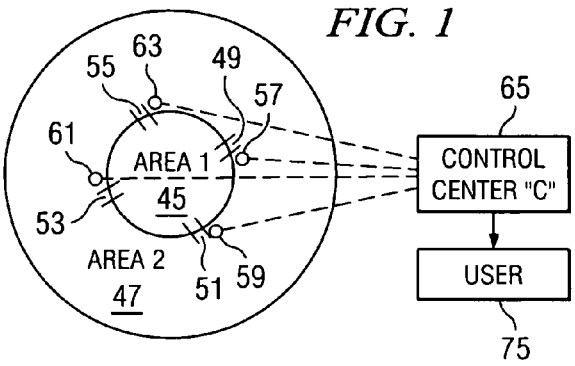
FIG. 1 is a diagrammatic view of the monitoring and location system of the invention showing the location of local and wide area, the control center and host computer, interrogation units and an example of communication therebetween.
Figure 2:
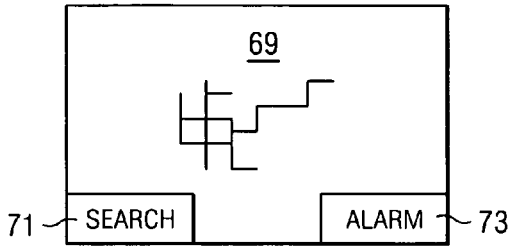
FIG. 2 is a diagrammatic of a graphical user interface ("GUI") of the type present in the control center showing a video screen and buttons labeled with "Search" and "Alarm" situated below the video display.

This invention relates to a monitoring and location system for people, objects and things (referred to herein collectively at times as "mobile objects"). The primary purpose of the monitoring and location system of the invention is to monitor and track people and animals and especially for young children who might wander form a protected zone to another zone, as well as for others not necessarily able to care for themselves. For example, young children might wander outside of a building or confined area such as a preschool, shopping mall, theme park or sports arena. Another example of the use of the present system would be in relation to people who can easily become confused or disoriented and who might want or need to be tracked, such as the elderly or infirm.

The system of the invention is implemented in two specific "areas". One of the areas is a "local" or internal area that would be very localized, such as within a home, within a school or a nursery or a hospital, for example. The system then identifies when a subject transitions between this local area and a "wide" area. The wide area might be, for example, the area outside a home, outside a school, outside a sports stadium, and the like.

The system of the invention uses a separate RFID tag for each mobile object of a group to be monitored. An RFID tag of a suitable size and configuration for the particular task at hand is affixed to the mobile object, as by attaching the RFID tag to a garment being worn by a person to be tracked. The RFID can then be interrogated by means of a suitable interrogation unit or reader to thereby obtain identifying information about the mobile object. In one preferred embodiment of the invention, the RFID tag is sewn within the lining of an article of clothing worn by a person to be tracked. By sewing the RFID tag within the hem of an article of clothing, within the lining of a hat, or within an inner recess in the shoes of the wearer, the tag is not easily detected or removed. This could prove to be especially valuable in the case of an attempted abduction of a child, for example.

RFID technology will first be described in general terms before turning to a specific end application of the invention. Whereas RFID's were, in the past, cost prohibitive, such devices can now be purchased commercially for on the order of 20 to 30 cents apiece, making them suitable for the purposes of the present invention. RFID tags are now well-known and typically include an integrated circuit (IC) that is operatively coupled to an antenna (the tag antenna). The tag may also have a battery, or it may have no battery and may instead obtain energy from an external reader. RFID tags without batteries may be preferred for applications in which lower cost is a dominant factor, and RFID tags with batteries may be preferred for applications in which a longer read range is preferred. Either or both may be used in conjunction with the present invention. The RFID tags of the present invention preferably resonate in the UHF or microwave frequency band, either of which enables an RFID reader to interrogate the tags from a sufficiently long read range to be useful.

The IC associated with an RFID tag typically includes a certain amount of memory in which a tag identifier is stored, and perhaps other information related to the tag, and/or the item or items with which the tag is to be associated. When an RFID reader (also known as an interrogator, either of which may read or write information to an RFID tag) transmits energy via its reader antenna to interrogate the RFID tag, the tag responds with information from which the reader can obtain the RFID tag identifier or other information. The data, identifier, or information obtained by the RFID reader may then be compared to entries in a database of identifiers or to information associated with that RFID tag. In that manner, information regarding an RFID-tagged item may be obtained, updated, and provided to a user, and/or written to an RFID tag, perhaps even in real-time.

As a typical example of RFID tags presently available in the marketplace, Escort Memory Systems, 3 Victor Square, Scotts Valley, Calif., offers the ES600 Series Read Only Tags which are encapsulated suitably to retain data integrity after exposure to temperatures on the order of 205° C. A companion interrogation unit or reader, the LRP2000-26 Long Range Reader can read tags at a height of six feet and at a width of four feet. This combination of tag and reader could be used for mobile objects passing through a defined point of ingress and egress, such as a doorway to a building, school, sports arena, or the like.

The invention is not intended to be limited to this particular commercially available system, however. There are other systems available, as well, that can perform the functions required by the monitoring and location system of the invention. Presently available RFID systems operate in both low frequency (less than 100 megahertz) and high frequency (greater than 100 megahertz) modes. Unlike their low-frequency counterparts, high-frequency tags can have their data read at distances of several meters, even while closely spaced together. New data can also be transmitted to the tags.

In the low-frequency system, an integrated circuit sends a signal to an oscillator, which creates an alternating current in the reader's coil. That current, in turn, generates an alternating magnetic field that serves as a power source for the tag. The field interacts with the coil in the tag, which induces a current that causes charge to flow into a capacitor, where it is trapped by the diode. As charge accumulates in the capacitor, the voltage across it also increases and activates the tag's integrated circuit, which then transmits its identifier code. High and low levels of a digital signal, corresponding to the ones and zeros encoding the identifier number, turn a transistor on and off. Variations in the resistance of the circuit, a result of the transistor turning on and off, cause the tag to generate its own varying magnetic field, which interacts with the reader's magnetic field. In this technique, called load modulation, magnetic fluctuations cause changes in current flow from the reader to its coil in the same pattern as the ones and zeros transmitted by the tag. The variations in the current flow in the reader coil are sensed by a device that converts this pattern to a digital signal. The reader's integrated circuit then discerns the tag's identifier code.

In the high-frequency system, an integrated circuit sends a digital signal to a transceiver, which generates a radio-frequency signal that is transmitted by a dipole antenna. The electric field of the propagating signal gives rise to a potential difference across the tag's dipole antenna, which causes current to flow into the capacitor; the resulting charge is trapped by the diode. The voltage across the capacitor turns on the tag's integrated circuit, which sends out its unique identifier code as a series of digital high- and low voltage levers, corresponding to ones and zeros. The signal moves to the transistor. The transistor gets turned on or off by the highs and lows of the digital signal, alternately causing the antenna to reflect back or absorb some of the incident radio frequency energy from the reader. The variations in the amplitude of the reflected signal, in what is called backscatter modulation, correspond to the pattern of the transistor turning on and off. The reader's transceiver detects the reflected signals and converts them to a digital signal that is relayed to the integrated circuit, where the tag's unique identifier is determined.

Figure 5:
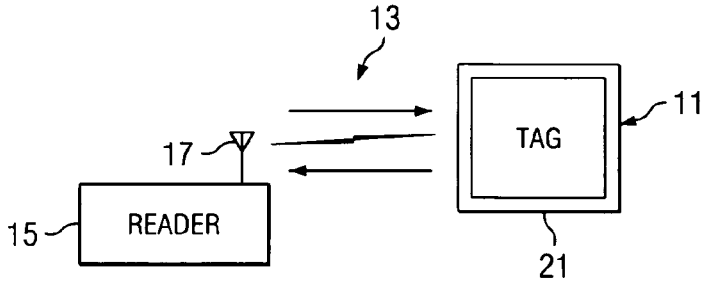
FIG. 5 is a block diagram of an RFID tag and associated interrogation unit or reader of the type useful in the practice of the present invention.

Referring first to FIG. 5, the operation of the RFID tag and associated interrogation unit or reader will first be described. FIG. 5 shows, in block diagram fashion, a remote intelligent communication device 11, which for purposes of this invention is an RFID tag or chip. The RFID tag 11 is used with an associated interrogation unit or reader 15. The RFID tag 11 communicates via wireless electronic signals, in this case radio frequency (RF) signals, with the reader 15. Radio frequency signals including microwave signals can be utilized. The communication system 13 includes an antenna 17 coupled to the reader 15.

Figure 6:
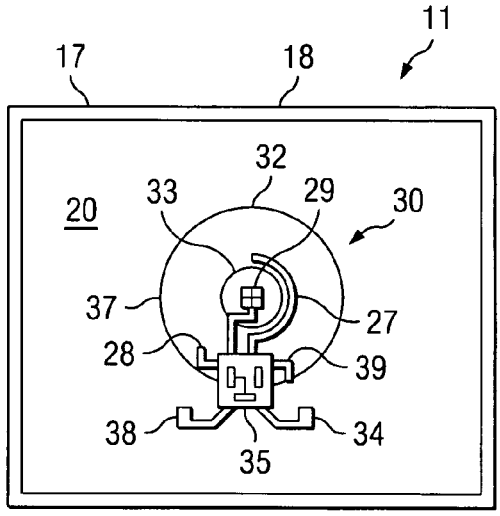
FIG. 6 is a front, partly schematic view of an RFID tag of an especially robust nature useful in practicing the invention with the cover layer removed for ease of illustration.

Referring to FIG. 6, one form of the wireless communication device 11 which is useful for purposes of the present invention is shown. The device 11 is of the general type shown in issued U.S. Pat. No. 6,666,379, although it will be understood that other commercially available "tags" such as the previously described Escort Memory Systems ES-600 Series can be utilized, as well, depending upon the manner in which the tag is affixed to the mobile object. The device 11 includes an insulative substrate or layer of supportive material 18. Example materials for the substrate 18 comprise polyester, polyethylene or polyimide film having a thickness of 3-10 mils.

Substrate 18 provides a first or lower portion of a housing for the wireless communication device 11 and defines an outer periphery 21 of the device 11. Substrate 18 includes a plurality of peripheral edges 17. A support surface 20 is provided to support components and circuitry formed in later processing steps upon substrate 18. In FIG. 6, support surface 20 comprises an upper surface of the layer shown.

A patterned conductive trace 30 is formed or applied over the substrate 18 and atop the support surface 20. A preferred conductive trace 30 comprises printed thick film (PTF). The printed thick film comprises silver and polyester dissolved into a solvent. One manner of forming or applying the conductive trace 30 is to screen or stencil print the ink on the support surface 20 through conventional screen printing techniques. The printed thick film is preferably heat cured to flash off the solvent and UV cured to react UV materials present in the printed thick film.

The conductive trace 30 forms desired electrical connections with and between electronic components which will be described below. In one embodiment, substrate 18 forms a portion of a larger roll of polyester film material used to manufacture multiple devices 10. In such an embodiment, the printing of conductive trace 30 can take place simultaneously for a number of the to-be-formed wireless communication devices.

The illustrated conductive trace 30 includes conductive lines and patterns, such as an electrical connection 28, a first connection terminal 29 and a second connection terminal 27. Conductive trace 30 additionally defines transmit and receive antennas 32, 34 in one embodiment of the invention. Antennas 32, 34 are suitable for respectively transmitting and receiving wireless signals or RF energy. Transmit antenna 32 constitutes a loop antenna having outer peripheral edges 37. Receive antenna 34 constitutes two elongated portions individually having horizontal peripheral edges 38.

One embodiment of a wireless communication device 11 includes a power source 33, an integrated circuit chip 35, and capacitor 39. Power source 33, capacitor 39, and integrated circuit chip 35 are provided and mounted on support surface 20 and supported by substrate 18. The depicted power source 33 is disposed within transmit antenna 32 of wireless communication device 11. Capacitor 39 is electrically coupled with loop antenna 32 and integrated circuit 35 in the illustrated embodiment.

Power source 33 provides operational power to the wireless communication device 11 and selected components therein, including integrated circuit 35. In the illustrated embodiment, power source 33 is preferably a thin profile battery which includes first and second terminals of opposite polarity. More particularly, the battery has a lid or negative (i.e., ground) terminal or electrode, and a can or positive (i.e., power) terminal or electrode.

It is important for purposes of the present invention that the RFID be heat and pressure tolerant. In order to achieve this result, the electronic components are ultimately encapsulated, either chemically or physically, in a protective barrier type material or materials. In the embodiment illustrated in FIGS. 5 and 6, conductive epoxy is applied over desired areas of support surface 20 using conventional printing techniques, such as stencil or screen printing, to assist in component attachment described just below. Alternately, solder or another conductive material is employed instead of conductive epoxy. The power source 33 is provided and mounted on support surface 20 using the conductive epoxy. Integrated circuit 35 and capacitor 39 are also provided and mounted or conductively bonded on the support surface 20 using the conductive epoxy.

Integrated circuit chip 35 includes suitable circuitry for providing wireless communications. For example, in one embodiment, integrated circuit chip 35 includes a processor, memory, and wireless communication circuitry or transponder circuitry for providing wireless communications with reader 15.

One embodiment of transponder circuitry includes a transmitter and a receiver respectively operable to transmit and receive wireless electronic signals. In particular, transponder circuitry is operable to transmit an identification signal responsive to receiving a polling signal from reader 15. Specifically, the processor is configured to process the received polling signal to detect a predefined code within the polling signal. Responsive to the detection of an appropriate polling signal, the processor instructs transponder circuitry to output an identification signal. The identification signal contains an appropriate code to identify the particular device 11 transmitting the identification signal in certain embodiments. The identification and polling signals are respectively transmitted and received via antennas 32, 34 of the device 11.

First and second connection terminals 29, 27 are coupled to the integrated circuit 35 by conductive epoxy in accordance with a preferred embodiment of the invention. The conductive epoxy also electrically connects the first terminal of the power source 33 to the first connection terminal 29.

Subsequently, conductive epoxy is dispensed relative to the edge 37 and electrically connects the edge with connection terminal 27. In the illustrated embodiment, the edge 37 defines the can of the power source 33. The conductive epoxy connects the positive terminal of the power source 33 to connection terminal 27. The conductive epoxy is then cured. Thus, the integrated circuit and battery are conductively bonded relative to the substrate and to the conductive lines of trace.

An encapsulant, such as encapsulating epoxy material, is subsequently formed following component attachment. In one embodiment, the encapsulant is provided over the entire support surface 20. This material encapsulates or envelopes the antennas 32, 34, integrated circuit 35, power source 33, conductive circuitry 30, capacitor 39, and at least a portion of the support surface 20 of substrate 18. The encapsulant operates to insulate and protect the components (i.e., antennas 32, 34, integrated circuit 35, power source 33, conductive circuitry 30 and capacitor 39).

A flowable encapsulant is preferably applied over substrate 18 and subsequently cured following the appropriate covering of the desired components. In the preferred embodiment, such encapsulant constitutes a two-part off the shelf epoxy which typically includes fillers such as silicon and calcium carbonate. The preferred two-part epoxy is sufficient to provide a desired degree of flexible rigidity. Specifically, the preferred epoxy comprises a two-component system having a liquid resin material and a liquid hardener material. The resin typically constitutes three times the volume of the hardener within the liquid mixture from which the two-part system cures. Adequate and complete mixing of the resin/hardener two-component epoxy system occurs prior to dispensing or otherwise providing the liquid encapsulant atop the substrate, chip, and battery. Other encapsulant materials of the insulative layer can also be used in accordance with the present invention. Such encapsulation would preferably occur from fabrication of multiple device patterns formed on a single substrate sheet, and then cutting individual devices 11 from the sheet after encapsulation and cure.

Figure 7:
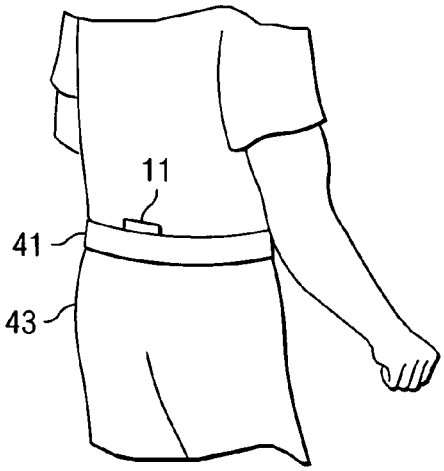
FIG. 7 is a simplified, perspective view of a portion of a user's profile, showing a garment identification tag in place on the garment being worn.

FIG. 7 shows a completed tag 11 which has been attached to a garment, in this case the waist lining 41 of a pair of pants 43. The tag 11 is not easily visible and is attached by, e.g., sewing in a hem or liner of a garment, or by gluing or otherwise affixing the tag to the garment.

In addition to the previously described chemical encapsulation method, it will be understood that the RFID's of the invention can be physically or mechanically isolated from various environmental factors, as well. The RFID's of the invention must be capable of existing in a variety of environments and must therefore be encapsulated or isolated for durability against shock, fluids, dust or dirt, and the like. Although a variety of tags are commercially available which will suffice in most home environments, they must be isolated or protected to withstand the high temperature environment of, for example, a dry cleaning operation.

In additional envisioned embodiments of the invention, the electrical components are physically or mechanically isolated from the environment by providing the substrate with a top and bottom comprised of substantially flexible, high temperature resistant materials. Preferably, the substrate with its electrical components are housed in a top and bottom layers comprised of a substantially flexible polymeric material such as a polyimide, for example, Kapton™. In one embodiment of the invention, the substrate is joined to top and bottom layers by means of a thermally resistant, substantially flexible silicone encapsulant on one side and with a high temperature adhesive on the other side. In a preferred embodiment, the silicone encapsulant can comprise Stycas™ 4952 (manufactured by Emerson & Cuming Specialty Polymers). The high temperature adhesive can comprise, for example, 3M.RTM.-9460PC, having a temperature rating in the range of 500° F.

Referring back now to FIGS. 1-4, an RFID tag system is provided for tracking in real-time the location of a group of individuals within a defined environment. In general, the method includes: (a) an identification gag worn by each individual of the group; (b) means for communicating with each tag as it moves with the individual through the environment and (c) means for using the communication to determine the position of the gag in the environment and, alternatively, transmitting an alarm if the tag has left a prescribed area. The prescribed local areas comprise a plurality of zones which include egress zones and ingress zones, each zone being provided with its own RFID interrogation unit for monitoring the ingress and egress, respectively, or its own group of RFID tags. When an RFID tag has egressed or ingressed one of the zones, the RFID transmits identifying indicia to the RFID interrogation unit of one of the associated zones. When the RFID interrogation unit has received the indicia, the RFID interrogation unit transmits a signal including the indicia to a control center.

Thus, with reference to FIG. 1, the monitoring environment includes a local zone 45 and a wide zone 47. There are a number of ingress and egress zones from one zone to the other, designated as 49, 51, 53, 55. Each ingress and egress zone also has its own RFID interrogation unit or reader 57, 59, 61, 63 for monitoring the ingress and egress, respectively, of its own group of RFID tags. The interrogation units 57, 59, 61, 63 are, in turn, in communication with one or more control centers which monitor the movement of mobile objects to and from a prescribed local area to a prescribed wide area. In other words, when an RFID tag has egressed or ingressed one of the zones of interest, the RFID tag transmits its unique electronic indicia to the RFID interrogation unit of one of the zones. When the RFID interrogation unit has received such indicia, the RFID interrogation unit transmits a signal including said indicia to the control center 65.

The control center 65 would include at least a central microprocessor for receiving and storing information received from the various interrogation units 57, 59, 61, 63 within its assigned environment. Preferably, the control center 65 would include a graphical user interface ("GUI") 67 provided for communication between the host computer and system operator. The GUI in the example shown includes a large video screen (69 in FIG. 2) showing a plan drawing of the environment being monitored (in this case the floor plan of a building) as well as "Search" and "Alarm" buttons, 71, 73, respectively. These are preferably "soft" buttons that are activated by pointing and clicking with a mouse or by use of a "touch screen." As the system identifies the location of individuals of the group, an icon with a picture of the individuals is displayed on the map at their location. In an alternative embodiment, the picture can be replaced by symbol and the GUI can display a key that links the symbol with the name or picture of the individual.

The control center 65, in turn, communicates with one or more end users or subscribers (75 in FIG. 1). The end user might be, for example, a concerned parent whose child was attending a sporting even or concert in a large arena. The control center would communicate with the end user 75 in any of a variety ways. Preferably, the control center 65 communicates with the end user 75 by wireless connection to a cell phone, PDA, pager, or other dedicated personal electronic device which is worn by the end user or carried by the end user.

Figure 3:
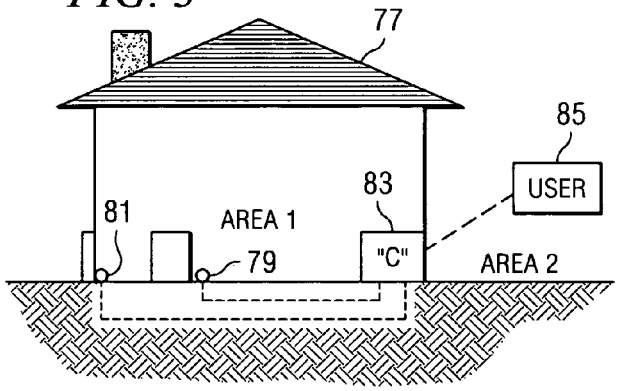
FIG. 3 is a simplified depiction of a home having a local and a wide area, a control center and a plurality of interrogation units.

FIG. 3 shows a specific application of the system of the invention in which a house 77 has an interior representing the "local" area with the exterior of the house representing the "wide" area (designated as Area 1 and Area 2 in the drawing). Each door way to the exterior is equipped with a reader or interrogation unit 79, 81 which, in turn, communicates with the control center 83 which might take the form of a control console in the kitchen of the house. The control center could output wireless information to the end user 85, in this case a parent tracking the location of one or more children. A house, for example, might monitor ingress and egress on an overhead monitor and alerts might also be sent to a cell phone or PDA.

Figure 4:
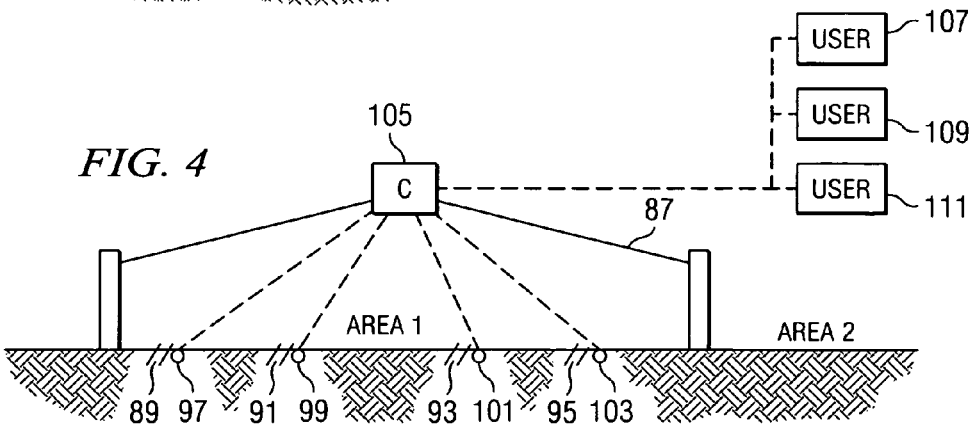
FIG. 4 is a simplified depiction of a sports area having a local area, wide area, a control center an associated interrogation units, similar to FIG. 3.

FIG. 4 is a view similar to FIG. 3, in which a sports arena 87 has a number of gates 89, 91, 93, 95, each of which is equipped with an RFID reader 97, 99, 101, 103. The readers communicate with the control center 105 which, in turn, communicates wirelessly with the end users 107, 109, 111. In the case of the sports arena 87, the central microprocessor which is provided as a part of the control center sends an alert to a system user when an RFID tag being tracked leaves a selected one of the local areas by means of a personal electronic device carried by the system user. The system can also broadcast alerts to, for example, security personnel in case of a missing person.

The present system can be used to improve safety of children particularly at large facilities such as theme parks, sporting arenas, or the like, because it can help to locate children on a real time basis. The implementation of the system of the invention provides a safer environment for children which gives parents greater peace of mind. The system allows end users access to the system and its information and the ability to locate a person quickly and easily through the ID stations at the points of ingress and egress. This saves valuable time, effort and energy. The system also provides authorities with the ability to determine quickly if a patron has wrongly entered a restricted area.

The system can be used to track individuals in a large group (e.g., groups of tourists or large parties) who often separate from one another during a group outing. Members of the group can quickly locate other members of their party to meet or in the case of an emergency. The system also provides security personnel with the ability to quickly come to the aid of missing children or parents and to assist in reuniting them. In certain particular implementations of the system, the results of the monitoring activity can be used to provides data for market research by being able to track the movement of customers in the particular commercial business.

While the invention has been described with reference to only a limited number of embodiments, it will be appreciated that various changes and modifications can be made without departing from the scope of the invention which is limited only by the appended claims.

I claim:

1. A monitoring and location system for mobile objects, the system comprising:

a control center to monitor the movement of mobile objects to and from a prescribed local area and a prescribed wide area;

a separate RFID tag for each mobile object of a group being monitored;

wherein the mobile object is a person to be tracked and wherein said RFID tag is carried upon the person to be tracked and is affixed to a selected one of a garment, hat or shoes of the person, each RFID tag having a unique electronic indicia stored thereon for transmission by a radio frequency signal upon request from an RFID interrogation unit;

wherein the prescribed local areas comprise a plurality of zones which include egress zones and ingress zones, each zone having its own RFID interrogation unit for monitoring the ingress and egress, respectively, of its own group of RFID tags;

wherein, when an RFID tag has egressed or ingressed one of the zones, said RFID transmits its unique electronic indicia to the RFID interrogation unit of one of the zones, and when the RFID interrogation unit has received the indicia, the RFID interrogation unit transmits a signal including such indicia to the control center;

wherein the control center further comprises:

means for receiving transmissions from a plurality of RFID tags;

means for selectivity displaying the location of the RFID tags; and an alarm for indicating receipt of the indication that the tag, and hence an associated mobile object, has left the defined area; and wherein the control center sends an alert to a system user when an RFID tag being tracked leaves a selected one of the local or wide areas by means of a personal electronic device carried by the system user, the personal electronic device being selected form the group consisting of a cell phone, a PDA, a pager and a wrist watch.

2. The system of claim 1, wherein the RFID is sewn within a lining of an article of clothing worn by the person to be tracked.

3. The system of claim 1, wherein said means for transmitting and said means for receiving comprise a host computer with at least one microprocessor.

4. The system of claim 3, wherein said local area is an area selected from the group consisting of schools, sports arenas, museums, amusement parks, casinos, hotels, zoos, ski resorts, shopping malls, homes and residences, and neighborhood associations.

5. The system of claim 4, wherein said means for communicating information about the location of individuals of the group at the control station comprises the preparation of a map of the environment and display of the map at a video terminal.

6. The system of claim 5, wherein said displayed map includes different icons or pictures each representing an individual of the group wherein the icons or pictures are located at the position on the map corresponding to the position where the individual is in the environment.

7. The system of claim 6, further including connection of the host computer to a security force which is notified when an alarm is broadcast by the control center.

8. The system of claim 1, wherein the RFID tag is encapsulated in an encapsulating material which renders is impervious to normal environmental influences.

9. The system of claim 8, wherein the RFID is encapsulated in a liquid resin which is subsequently cured.

10. The system of claim 9, wherein the RFID is encapsulated in an epoxy resin.

11. The system of claim 8, wherein the RFID contains sensitive electrical components and wherein the sensitive electrical components are physically isolated from the environment by enclosing the components in a top and bottom layer of heat resistant polymeric materials.

* * * * *